US006746017B2

(12) United States Patent
Yu et al.

(10) Patent No.: US 6,746,017 B2
(45) Date of Patent: Jun. 8, 2004

(54) SEQUENCE TILE BOARD GAME

(75) Inventors: Brian Yu, Hawthorne, CA (US); Jonathan Bedford, Hawthorne, CA (US)

(73) Assignee: Mattel, Inc., El Segundó , CA (US)

( * ) Notice: Subject to any disclaimer, the term of this patent is extended or adjusted under 35 U.S.C. 154(b) by 0 days.

(21) Appl. No.: 10/286,475

(22) Filed: Oct. 31, 2002

(65) Prior Publication Data

US 2003/0111792 A1 Jun. 19, 2003

Related U.S. Application Data

(60) Provisional application No. 60/350,139, filed on Nov. 2, 2001.

(51) Int. Cl.[7] ..... A63F 3/00
(52) U.S. Cl. ..... 273/273; 273/292
(58) Field of Search ..... 273/269, 270, 273/273, 292, 236, 272, 276

(56) References Cited

U.S. PATENT DOCUMENTS

| | | | | |
|---|---|---|---|---|
| 3,618,952 A | | 11/1971 | Tallarida | |
| 3,649,024 A | * | 3/1972 | Katzman | 273/273 |
| 3,779,557 A | | 12/1973 | Kritzberg et al. | |
| 4,036,492 A | | 7/1977 | Breslow | |
| 4,302,015 A | | 11/1981 | Bowser et al. | |
| 4,448,423 A | | 5/1984 | Augusta | |
| 4,496,327 A | | 1/1985 | Bennett | |
| 4,560,171 A | | 12/1985 | Anthony | |
| 4,659,085 A | | 4/1987 | DeVries | |
| 4,690,410 A | | 9/1987 | Berton | |
| 5,029,871 A | | 7/1991 | Willson et al. | |
| 5,306,153 A | | 4/1994 | Foster | |
| 5,324,040 A | | 6/1994 | Panda | |
| 5,377,990 A | * | 1/1995 | Seeney-Sullivan | 273/236 |
| 5,997,304 A | | 12/1999 | Wood | |
| 6,065,752 A | | 5/2000 | Beltran | |
| 6,402,144 B1 | | 6/2002 | Ekberg | |
| 6,425,581 B1 | * | 7/2002 | Barrett | 273/157 R |

FOREIGN PATENT DOCUMENTS

| | | |
|---|---|---|
| GB | 2251805 | 7/1992 |
| GB | 2324478 | 10/1998 |
| WO | WO 02/056982 | 7/2002 |

* cited by examiner

*Primary Examiner*—William M. Pierce
(74) *Attorney, Agent, or Firm*—Kolisch Hartwell, P.C.

(57) ABSTRACT

The present invention provides a board game wherein players compete to uncover tiles and board sections in an order that matches a drawn card. The game includes a game board, player pieces, tiles, and sequence cards. The object of the game is to advance through several levels of play by matching uncovered indicia to that of the sequence cards while avoiding penalty indicia.

13 Claims, 3 Drawing Sheets

SEQUENCE TILE BOARD GAME

CROSS-REFERENCE TO RELATED APPLICATIONS

This application claims priority under 35 U.S.C. §119(e) to U.S. Provisional Patent Application No. 60/350,139 entitled "Sequence Tile Board Game," filed Nov. 2, 2001, the disclosure of which is herein incorporated by reference.

BACKGROUND OF THE INVENTION

The present invention relates generally to games played by multiple players. More specifically, the present invention relates to methods and apparatus for playing a sequence based guessing game for multiple players.

SUMMARY OF THE INVENTION

The object of the game is for players to move a game piece from a starting position to an ending position, with forward and backward moves controlled by the results of turning over one card out of a first group of cards, and several cards out of a second group of cards. The game is turn based and each player begins the game with a game piece at a fixed number of moves away from the winning end position. Players take turns until one player has reached the winning end position.

The advantages of the present invention will be understood more readily after a consideration of the drawings and the Detailed Description of the Preferred Embodiment.

DETAILED DESCRIPTION OF THE PREFERRED EMBODIMENT

The present invention is a board game played by at least two players. The game requires that players take turns flipping sequence cards and trying to uncover the sequence indicated on the sequence card that might be found in cards laid face down on a game board. In one embodiment, the game may be based on a well-known popular culture phenomenon, such as a comic book or cartoon. For example, the embodiment of the present invention shown in FIG. 1 is based on the popular children's comic book YU-GI-OH, by Kazuki Takahashi.

Figure 1:
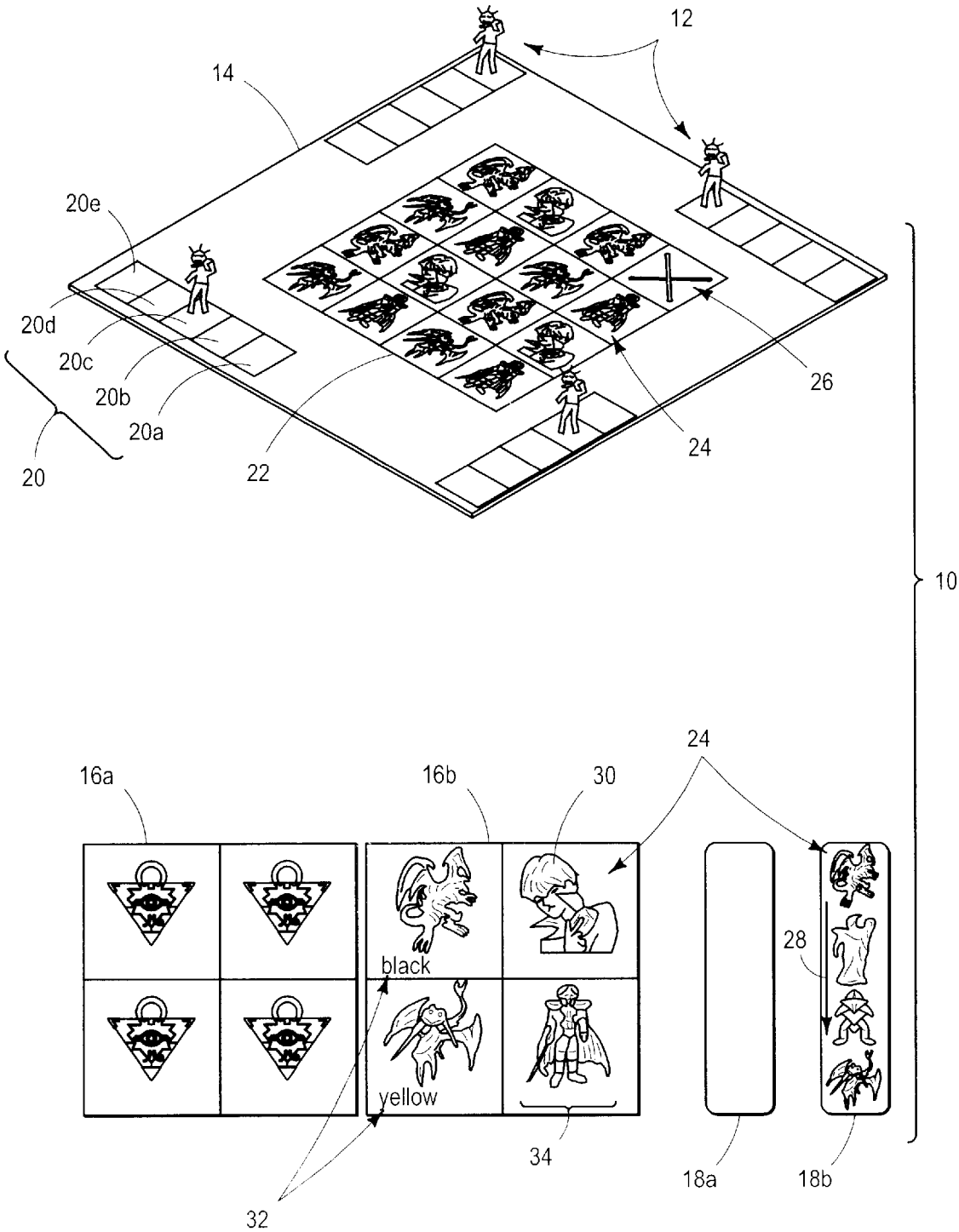
FIG. 1 depicts components of a game, including player pieces, a game board, tiles, and sequence cards.

Turning to FIG. 1, a set forming a game 10 is shown, according to one embodiment of the present invention. Game 10 includes player pieces 12, game board 14, tiles 16, and sequence cards 18.

Game board 14 is divided into level indicators 20 and grid spaces 22. Level indicators 20 are subdivided into a starting level 20*a*, intermediate levels, 20*b*, 20*c*, and 20*d*, and a winning level 20*e*. The object of the game is to advance to the highest level 20. Level indicators 20 are used in conjunction with player pieces 12 to track the progress of each player. The remainder of game board 14 is divided into multiple grid spaces 22 that are the same size as tiles 16 so that tiles 16 may be placed over, and completely cover, grid spaces 22.

Tiles 16 include a back side 16*a* and a front side 16*b*. The appearance of back sides 16*a* of tiles 16 are typically common to all other tiles 16 so that they appear identical. Front sides 16*b* of tiles 16 and grid spaces 22 each have one of a variety of graphic indicia 24 printed thereon. Graphic indicia 24 may also include penalty indicia 26.

Sequence cards 18 have a back side 18*a*, which is typically blank, and a front side 18*b*. The front sides 18*b* are imprinted with a sequence 28 of different graphic indicia 24 that match the various graphic indicia 24 imprinted on tiles 16 and grid spaces 22. Although sequence 28 of FIG. 1 includes four graphic indicia 24, the number of graphic indicia 24 may be changed to alter game 10 complexity. Graphic indicia 24 may be depicted by a picture 30, a color 32, or a combination of picture and color 34.

Figure 2:
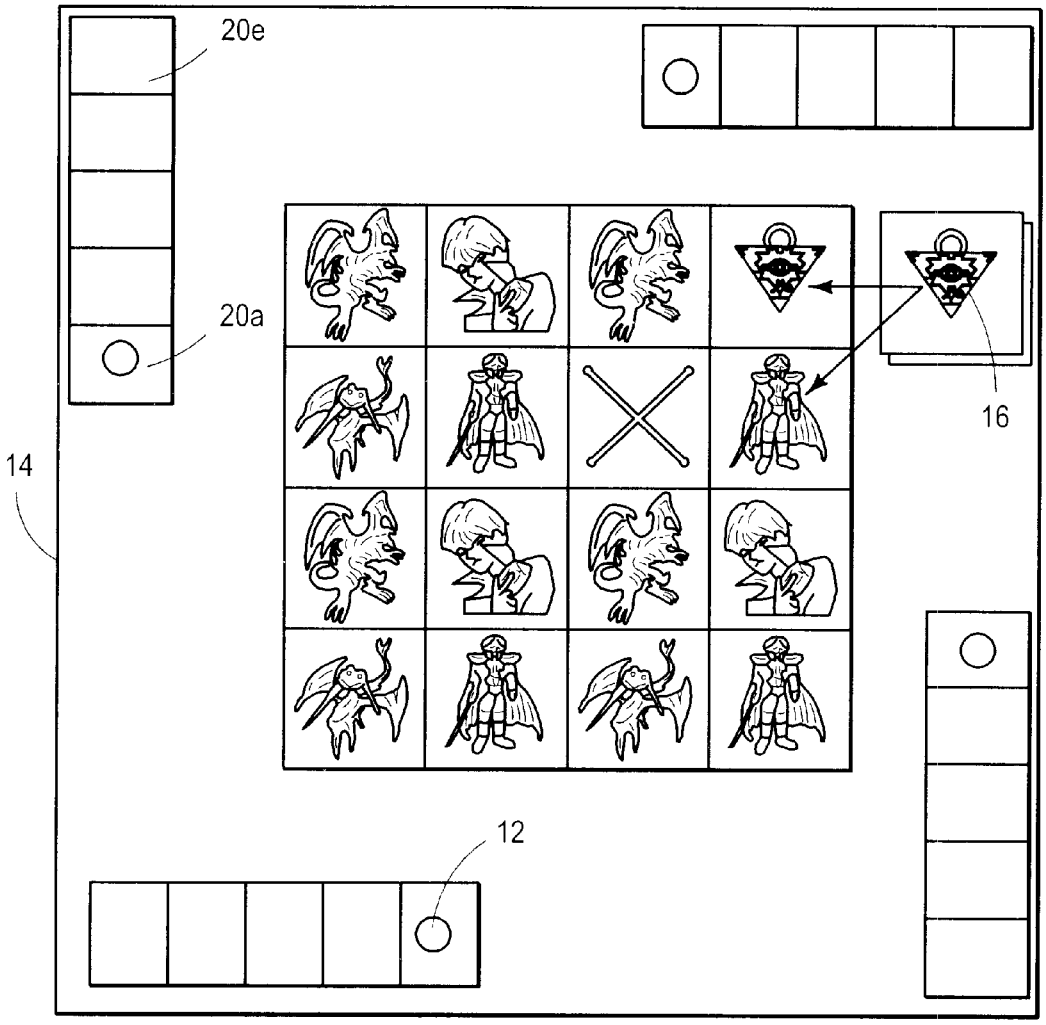
FIG. 2 shows the layout of game components at the beginning of play.

Each player starts the game with his or her player piece 12 positioned on his or her respective starting level indicator 20*a*, shown in FIG. 2 by a circle. During play, tiles 16 are typically randomized and placed front side 16*b* down on game board 14, as shown in FIG. 2. A player turns one of the sequence cards 18 front side 18*b* up to reveal the sequence 28 that that player will try to uncover on game board 14.

Figure 3:
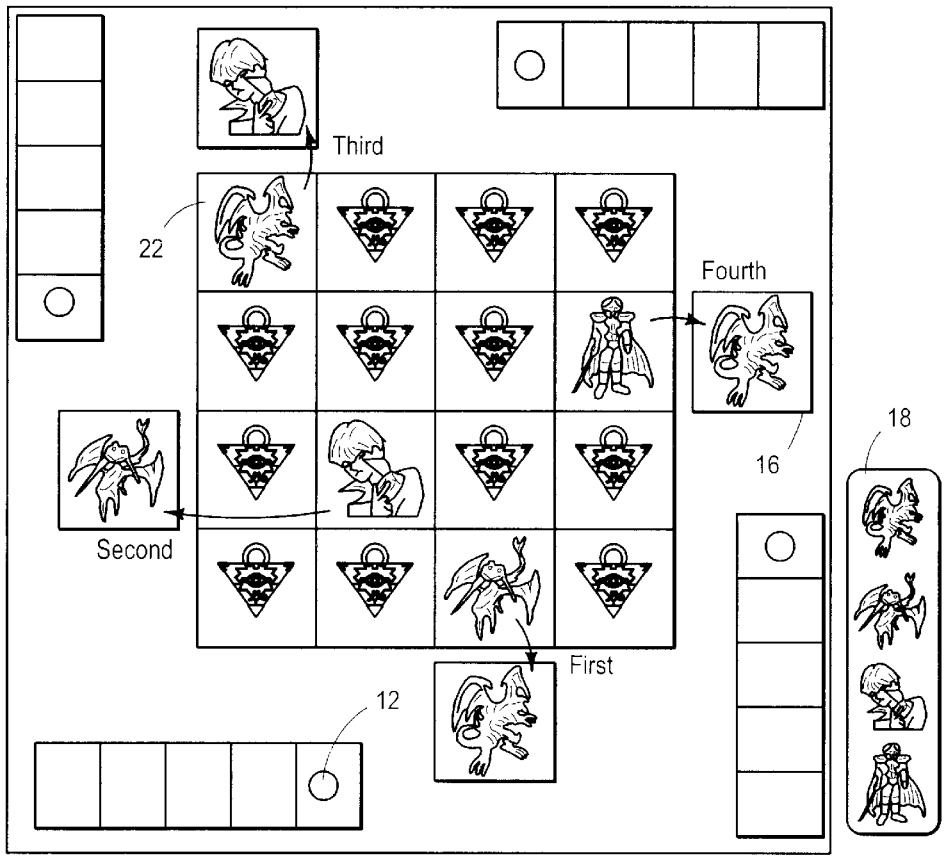
FIG. 3 depicts the method of matching graphic indicia to a sequence card.

A player moves to the next higher level by successfully uncovering the graphic indicia 24 in the sequence 28 called for by the over turned sequencing card 18. The player has two chances with each tile turned over to uncover the correct graphic indicia 24, because both the graphic indicia 24 printed on the front side of tile 16 or the graphic indicia 24 printed on grid space 22 that was uncovered may be correct. For example, if the over turned sequencing card 18 has a dark colored dragon, a light colored dragon, a character's profile, and a warrior graphic, as shown in FIG. 3, then the player must flip four of tiles 16 to reveal first a dark colored dragon, a light colored dragon, a character's profile, and finally a warrior graphic on either the flipped tile 16 or the uncovered grid space 22. If a player successfully matches sequence 28, then that player is awarded by moving his or her player piece 12 up a level 20.

A player may go down a level 20 if the player uncovers a specially designated graphic indicia 24 determined to be a penalty indicia 26. For example, if an "X" graphic indicia 24 is designated by a set of rules as the penalty indicia 26 and a player flips a tile 16 or uncovers a grid space 22 with an "X" indicia that player is assessed a penalty, which is typically to move his or her player piece 12 back one level 20. Exceptions to this penalty rule may apply, such as if the player flips over a tile 16 with the correct indicia 24, although penalty indicia 26 may be exposed on uncovered grid space 22, that player is not penalized since the sequence 28 was completed.

Once a sequence 28 has been correctly matched, tiles 16 are typically randomized and replaced on game board 14 in a new configuration before the next player draws another sequence card 18. If a sequence 28 was not correctly matched, that sequence card 18 is passed to the next player until the sequence 28 is correctly matched.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A board game apparatus comprising:

a game board, wherein the game board is divided into multiple grid spaces, each grid space imprinted with a distinguishing indication selected from a set of distinguishing indicia;

multiple tiles, each imprinted with an indication selected from the set of indicia, wherein the tiles are adapted to be placed face down over the grid spaces so that the indicia on the grid spaces and the tiles are hidden; and multiple sequence cards, each imprinted with at least two distinguishing indicia configured in a particular order, each distinguishing indication imprinted on a card corresponding to at least one distinguishing indication imprinted on at least one of a grid space and a tile.

2. A board game apparatus in accordance with claim 1, wherein each distinguishing indication imprinted on the grid spaces, tiles and sequence cards includes at least one of a picture and a color.

3. A board game apparatus in accordance with claim 1, wherein the indicia on the tiles and the grid spaces include at least one indication not imprinted on a sequence card.

4. A board game apparatus comprising:

a game board divided into multiple grid spaces;

a group of first cards having at least one distinguishing indication and adapted to be placed upon the grid spaces; and a group of second cards, each second card having at least two indicia, and each indication on each second card corresponds to an indication on at least one of the first cards.

5. A board game apparatus in accordance with claim 4, where each indication on each second card also corresponds to an indication on at least one of the grid spaces.

6. A board game apparatus in accordance with claim 5, where each of the distinguishing indicia imprinted on the grid spaces, first cards, and second cards includes at least one of a picture and a color.

7. A board game apparatus in accordance with claim 5, where the indicia on at least one of the grid spaces and the group of first cards include at least one indication not imprinted on a sequence card.

8. A board game in accordance with claim 4, wherein each first card is sized to substantially correspond to a grid space.

9. A method of playing a board game by at least two players, comprising the steps of:

placing multiple player pieces on designated areas of a game board;

randomizing multiple tiles and placing them face-down on a grid of the game board, so that the identity of indicia printed on each of the tiles and the underlying grid section is concealed;

randomizing sequence cards and placing them in a deck;

drawing one of the sequence cards, upon which multiple indicia are printed;

turning over the number of tiles that matches the number of graphic indicia printed on the drawn sequence card in a particular order in an attempt to match the indicia on the tiles or underlying grid to the particular order of the indicia shown on the sequence card;

moving the player piece of a player up a level on the designated area of the game board, if that player correctly matches the particular order of the indicia on the tiles or underlying game board to the particular order of the indicia on the drawn sequence card;

passing the opportunity to select tiles to match the particular order of the indicia on the drawn sequence card, if the previous player did not select a correct match;

repeating the steps of randomizing the multiple tiles onto the grid of the game board and drawing of another sequence card when one of the players successfully matches the last drawn sequence card; and determining a winner based on who is the first player to progress to the highest level of the game.

10. A method of playing a board game by at least two players in accordance with claim 9, where the indicia are depicted by picture, color, or a combination of picture and color.

11. A method of playing a board game by at least two players in accordance with claim 9, where the indicia include penalty indicia, which designate a predetermined penalty to be assessed to that player.

12. A method of playing a board game by at least two players in accordance with claim 11, where the predetermined penalty requires a receiving player to move the corresponding player piece back one level.

13. A method of playing a board game, comprising:

placing tiles on grid spaces of a game board, so that indicia printed on at least one of the tiles and the underlying grid spaces are concealed;

drawing a sequence card from a deck of sequence cards each having a series of indicia corresponding to the indicia on at least one of the tiles and the grid spaces; and exposing an indication by removing a tile from the game board, for each indication in the series of indicia on the drawn sequence card, so long as an exposed indication corresponds with the associated indication in the series of indicia on the drawn sequence card.

* * * * *